US006444163B1

(12) United States Patent
Ueno et al.

(10) Patent No.: US 6,444,163 B1
(45) Date of Patent: Sep. 3, 2002

(54) HEAT SHIELDING APPARATUS FOR VERTICAL CONTINUOUS ANNEALING FURNACE

(75) Inventors: Naoto Ueno; Sachihiro Iida, both of Chiyoda-ku; Takaaki Kobashi; Motoki Imamura, both of Chiba, all of (JP)

(73) Assignee: Kawasaki Steel Corporation, Kobe (JP)

( * ) Notice: Subject to any disclaimer, the term of this patent is extended or adjusted under 35 U.S.C. 154(b) by 0 days.

(21) Appl. No.: 09/798,981

(22) Filed: Mar. 6, 2001

(51) Int. Cl.[7] ..... C21D 9/54

(52) U.S. Cl. ..... 266/103; 266/259; 432/77; 432/233

(58) Field of Search ..... 266/102, 103, 266/259; 432/77, 65, 233

(56) References Cited

U.S. PATENT DOCUMENTS 5,163,303 A * 11/1992 Miyata et al. ..... 62/50.2

6,007,761 A * 12/1999 Nakagawa et al. ..... 266/103

FOREIGN PATENT DOCUMENTS

| | | |
|---|---|---|
| EP | 61 084332 | 4/1986 |
| EP | 06 248354 | 9/1994 |
| JP | 52-71318 | 6/1977 |
| JP | 53-119208 | 10/1978 |
| JP | 53-130210 | 11/1978 |
| JP | A-57-23733 | 2/1982 |
| JP | A-57-79123 | 5/1982 |
| JP | U-63-119661 | 8/1988 |
| JP | 411279662 A * | 10/1999 |

* cited by examiner

*Primary Examiner*—Scott Kastler
(74) *Attorney, Agent, or Firm*—Oliff & Berridge, PLC

(57) ABSTRACT

A shielding apparatus for intercepting heat from a heating source disposed in a vertical continuous annealing furnace includes a double-walled tube having an outside atmosphere suction port projected horizontally or downward to be exposed to an outside atmosphere, and an exhaust port projected upward to be exposed to the outside atmosphere.

18 Claims, 9 Drawing Sheets

HEAT SHIELDING APPARATUS FOR VERTICAL CONTINUOUS ANNEALING FURNACE

BACKGROUND OF THE INVENTION

1. Field of Invention

This invention relates to a heat shielding apparatus for a vertical continuous annealing furnace in which heat treatment is performed on a metal strip while the strip is continuously transported.

2. Description of Related Art

Recently, an annealing process for recrystallizing steel strip after being subjected to cold rolling and for imparting good workability to the steel strip has been primarily carried out by continuous annealing instead of batch annealing. As a continuous annealing furnace for carrying out the continuous annealing, there are known horizontal continuous annealing furnaces, in which annealing is performed on a strip traveling along a horizontal pass, and vertical continuous annealing furnaces, in which a plurality of rolls are arranged in upper and lower portions of the furnace and annealing is performed on a strip traveling along a vertical pass. Of these continuous annealing furnaces, the vertical furnace is more advantageous for a mass-production process that is realized by increasing the passing (threading) speed of the strip.

Also, at present, indirect heating using a radiant tube is prevalent as a heating source for the vertical continuous annealing furnace, and steel strip is mainly heated with radiant heat from the heating source.

In a vertical continuous annealing furnace wherein a plurality of rolls are arranged in upper and lower portions of the furnace and annealing is performed on a steel strip being transported in the vertical direction by the rolls, while changing a travel direction from upward to downward or vice versa as the strip turns around each roll, it is important to prevent the steel strip from snaking or mistracking and to ensure stable passage of the strip. Generally, as shown in FIG. 11, each roll 12 arranged in the furnace is designed to have a convex roll crown with both shoulders tapered toward the ends. This design is intended to make the steel strip pass the furnace so that the strip always travels in match with the roll center, by utilizing a centering force (arrow F) acting on the strip, which has ridden over a tapered portion, in a direction from the roll edge toward the roll center based on a self-centering motion of the strip wound on the tapered portion of the roll with angle.

As shown in FIG. 12, however, radiant heat from a heating source (e.g., a radiant tube) 14 provided in the furnace heats not only a steel strip 10, but also the roll 12 arranged in the furnace. Therefore, an actual crown of the roll arranged in the furnace is given by the sum of a crown initially imparted to the roll (called an initial crown) and a crown imparted by the radiant heat from the heating source (called a thermal crown). As a result, when the temperature of the steel strip is lower than the roll temperature and when the thermal crown is larger than the initial crown, the temperature of a roll central portion is relatively reduced and the roll crown is rendered concave as indicated by solid lines in FIG. 12. If the steel strip 10 travels over the roll 12 having such a concave crown, a force produced in the width direction of the steel strip acts from the roll center toward the roll edge. Accordingly, once the steel strip undergoes snaking or mistracking, the strip is forced to ride over the roll edge beyond it at a stroke, which causes the problem during the strip passage that the strip comes into contact with the furnace wall.

To cope with this problem, some devices are proposed to prevent the roll temperature from being higher than the strip temperature , so, a shield plate has previously been provided to intercept the heat radiated from the heating source 14 toward the roll 12, as disclosed in Japanese Unexamined Utility Model Application Publication No. 63-119661. Also, Japanese Unexamined Patent Application Publication No. 57-79123 discloses a shielding apparatus employing a heat-resistant tube through which air, nitrogen gas or the like, flows for cooling.

Further, in view of the finding that a shield plate alone is not sufficient to suppress the thermal crown, Japanese Unexamined Patent Application Publication No. 52-71318 discloses a technique for spraying cooling gas to the roll to control the thermal crown in a positive way. Moreover, for the same purpose, Japanese Unexamined Patent Application Publication No. 53-119208 discloses a technique for water-cooling a roll edge portion, or changing a thermal conductivity between the roll central portion and the roll edge portion. In addition, Japanese Unexamined Patent Application Publication No. 53-130210 and Japanese Examined Patent Publication No. 57-23733 disclose techniques for arranging, separately from the rolls, a cooling apparatus that forms a cooling flow path.

Among the above-mentioned examples of the related art, techniques for suppressing the thermal crown imparted to the roll in a positive way are effective in preventing snaking of the strip, but have the problem of requiring a very large amount of equipment investment. Another problem is that, because of an increase in size of the apparatus itself, heat capacity of the apparatus is necessarily increased, which deteriorates the fuel unit consumption in the heating zone.

SUMMARY OF THE INVENTION

This invention has been made with the view of overcoming the above-described problems of the related art. An object of this invention is to provide an inexpensive and more efficient apparatus on the basis of the radiant heat shielding apparatus employing a cooling tube, which is disclosed in the above-cited Japanese Unexamined Patent Application Publication No. 57-79123, for example.

To achieve the above object, this invention provides a radiant heat shielding apparatus for a vertical continuous annealing furnace, in which a plurality of rolls are arranged in upper and lower portions of the furnace and heat treatment is performed on metal strip continuously transported by the rolls. The strip is transported in the vertical direction by the rolls while changing the travel direction from upward to downward, or from downward to upward, as the metal strip turns around each of the rolls. The radiant heat shielding apparatus is disposed below the roll positioned in the upper portion of the furnace, and/or above the roll positioned in the lower portion of the furnace, for intercepting heat radiated from a heating source provided within the furnace. Preferably, the radiant heat shielding apparatus is positioned just below the roll in the upper portion of the furnace, and/or just above the roll in the lower portion of the furnace. The radiant heat shielding apparatus comprises a double-walled tube including an inner tube having an outside atmosphere suction port projected horizontally or downward to be exposed to an outside atmosphere, and an outer tube having an exhaust port projected upward to be exposed to the outside atmosphere.

In the radiant heat shielding apparatus, preferably, the outer diameter D of the outer tube of the double-walled tube is not less than about 60 mm, the level difference H between the outside atmosphere suction port and the exhaust port of the double-walled tube is not less than about 150 mm, and the outer diameter D (unit: m) of the outer tube of the double-walled tube and the level difference H (unit: m) satisfy the following relationship:

$$D^2 \times \sqrt{(H)} \geqq 2.2 \times 10^{-3} \quad (1)$$

Further, according to this invention, some embodiments of the radiant heat shielding apparatus comprise a plurality of double-walled tubes as described above. The double-walled tubes are horizontally arranged just below the roll positioned in the upper portion of the furnace and/or just above the roll positioned in the lower portion of the furnace.

Alternatively, in some embodiments, the radiant heat shielding apparatus comprises one or more double-walled tubes as described above, and the double-walled tubes are used as support tubes and a shield plate is attached to the support tubes.

DETAILED DESCRIPTION OF PREFERRED EMBODIMENTS

Embodiments of this invention will be described below in detail with reference to the drawings.

A radiant heat shielding apparatus of this invention is disposed below (preferably just below) a roll positioned in an upper portion of a vertical continuous annealing furnace, and/or positioned above (preferably just above) a roll positioned in a lower portion of the furnace, for intercepting heat radiated from a heating source that is provided within the furnace, and the heat shielding apparatus is almost parallel to the roll.

Figure 1:
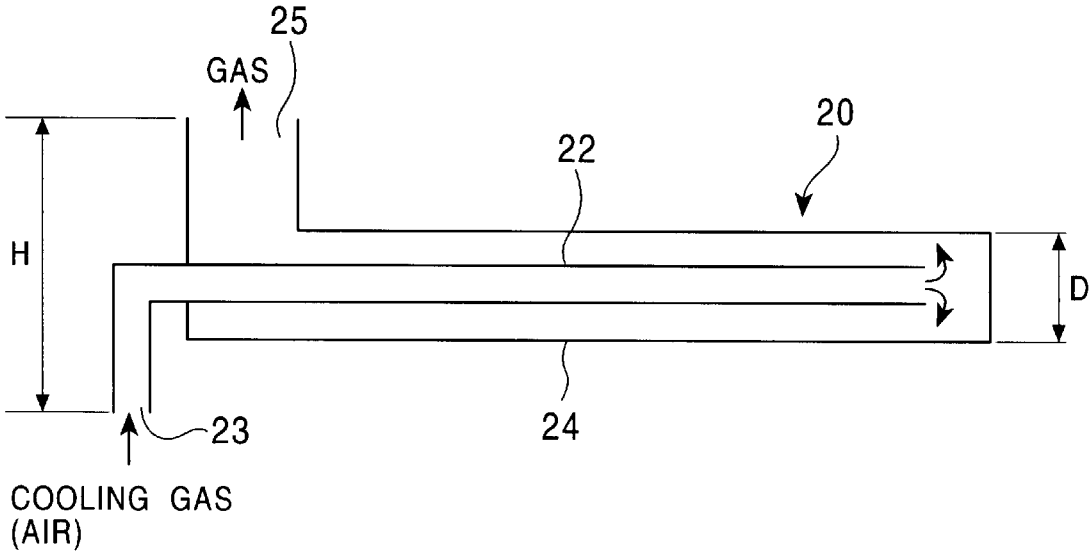
FIG. 1 is a vertical sectional view showing the construction of a double-walled tube for use in a first embodiment of a radiant heat shielding apparatus according to this invention.

In a first embodiment of this invention, as shown in FIG. 1, the radiant heat shielding apparatus has a structure of a double-walled tube 20 comprising an inner tube 22 having an outside atmosphere suction port 23 projected downward to be exposed to an outside atmosphere, and an outer tube 24 having an exhaust port 25 projected upward to be exposed to the outside atmosphere. With such a structure, an inexpensive and more efficient radiant heat shielding apparatus can be realized by effectively utilizing natural convection of the outside atmosphere (e.g., air).

Further, as a result of repeated experiments on the relationship among the flow rate of cooling gas (air) flowing through the double-walled tube 20, a radiant heat shielding effect, and high-temperature creep resistance of the double-walled tube, the inventors discovered a condition range suitable for intercepting the radiant heat in which an outer diameter D of the outer tube 24 of the double-walled tube 20 is not less than about 60 mm, a level difference (distance) H between the outside atmosphere suction port 23 and the exhaust port 25 is not less than about 150 mm, and the outer diameter D (unit: m) of the outer tube 24 of the double-walled tube and the level difference H (unit: m) satisfy the following formula (1):

$$D^2 \times \sqrt{(H)} \geqq 2.2 \times 10^{-3} \quad (1)$$

Heat-resistant alloy steel is an exemplary suitable material for forming the double-walled tube 20. For example, stainless steel having a Cr content of not less than about 18 wt % and a Ni content of not less than about 8 wt %, or special steel having high heat resistance, are preferred materials.

The inventors discovered that the radiant heat shielding apparatus employing a conventional cooling tube, disclosed in Japanese Unexamined Patent Application Publication No. 57-79123, has a limitation in its cooling capability utilizing natural convection of an outside atmosphere (air). Japanese Unexamined Patent Application Publication No. 57-79123 discloses that air for cooling is forced to flow into the cooling tube by a suction blower, or by a pressure blower. However, when a blower is provided on the suction side, the blower sucks exhaust gas at high temperatures, and therefore the blower must itself be made heat-resistant, or else a device for cooling suction gas must be provided upstream of the blower. In any case, the equipment cost is necessarily increased. On the other hand, when a pressure blower is used to force the cooling air to flow into the cooling tube, there is risk that a metal (or steel) strip is oxidized due to leakage of the air from the cooling tube into the furnace.

Figure 2:
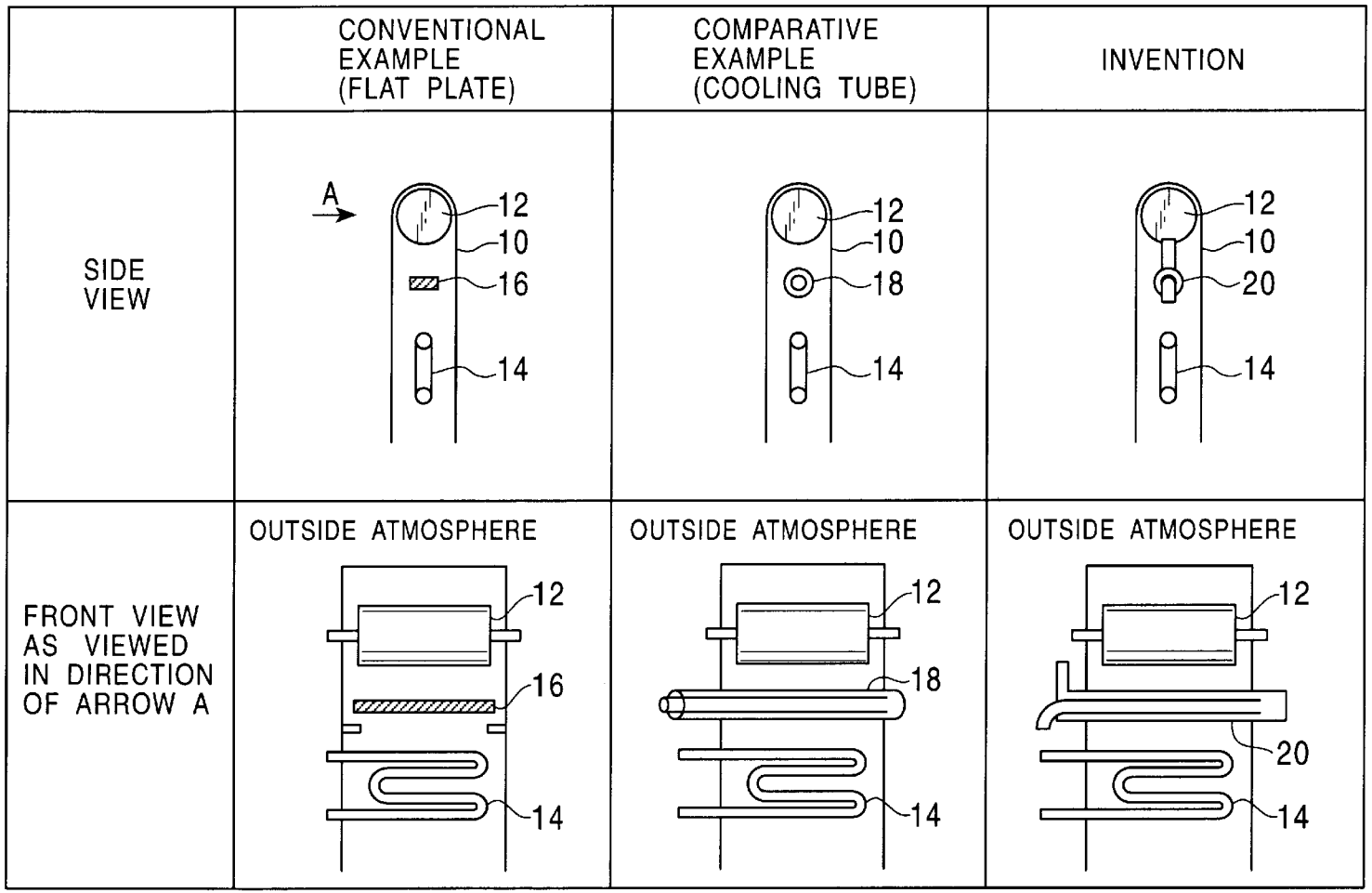
FIG. 2 includes side views and front views showing, for comparison, arrangements of a conventional example using a flat plate, a comparative example using a simple cooling tube, and the first embodiment using a cooling tube in the form of the double-walled tube according to this invention.

Based on the above findings, the inventors fabricated radiant heat shielding apparatuses having three types of structures shown in FIG. 2, and conducted tests on those actual apparatuses.

The left side of FIG. 2 represents a conventional example using a shield plate 16 in the form of a simple flat plate. A strip 10 (typically, a steel strip); a roll 12 arranged in a furnace; and a heating source 14 (typically, a radiant tube) are shown. The center of FIG. 2 represents a comparative example using a cooling tube 18 in the form of a simple straight double-walled tube. The right side of FIG. 2 represents the first embodiment of this invention including a cooling tube 20 in the form of the double-walled tube shown in FIG. 1.

Figure 3:
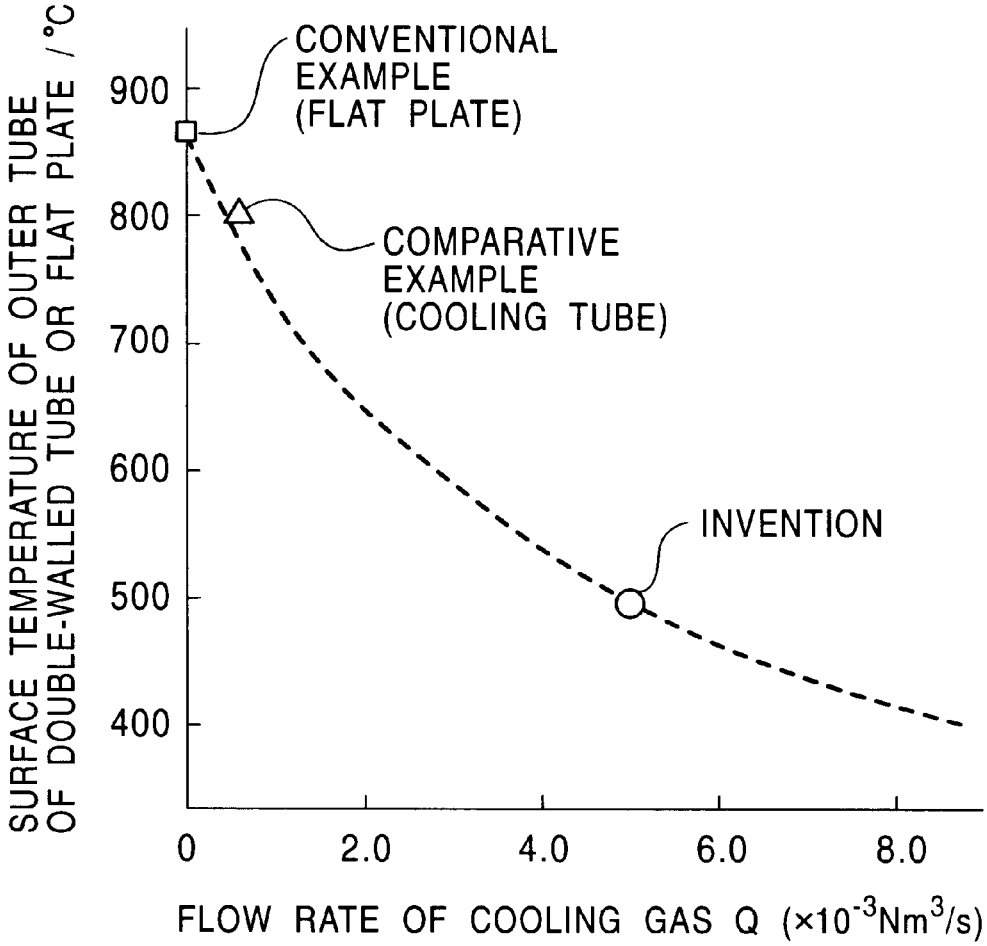
FIG. 3 is a graph showing, for comparison, the relationships between the flow rate of cooling gas (Q) and the surface temperature of an outer tube of each double-walled tube and a flat plate for explaining the principles of this invention.

FIG. 3 is a graph showing test results obtained by measuring a surface temperature of an outer tube of each double-walled tube and a flat plate (on the side facing the roll 12 arranged in the furnace), which is represented by the vertical axis, relative to a flow rate of cooling gas (air) measured at the exhaust port of the outer tube of each double-walled tube, which is represented by the horizontal axis. Measurement conditions were set such that the furnace temperature was 900° C. the temperature of the outside atmosphere (cooling gas) was 300° C. the outer tube diameter of the double-walled tube was 100 mm, the inner tube diameter of the double-walled tube was 40 mm, and the level difference H between the outside atmosphere suction port 23 and the exhaust port 25 of the double-walled tube was 200 mm.

In the comparative example using the cooling tube (simple straight double-walled tube) in which no improvements were made on the outside atmosphere suction port and the exhaust port, as indicated by marks Δ in FIG. 3, the flow rate of the cooling gas due to natural convection was small and the outer tube surface temperature of the double-walled tube reached 800° C.

In the conventional example (using the flat plate), as indicated by marks □, the surface temperature of the flat plate reached 860° C.

By contrast, in the first embodiment of this invention in which the double-walled tube was improved to have the outside atmosphere suction port and the exhaust port projected respectively downward and upward to be exposed to the outside atmosphere, as indicated by marks ○ in FIG. 3, the flow rate of the cooling gas reached to $5.0\times10^{-3}$ ($Nm^3/s$) and the surface temperature of the outer tube was reduced down to about 500° C.

Figure 4:
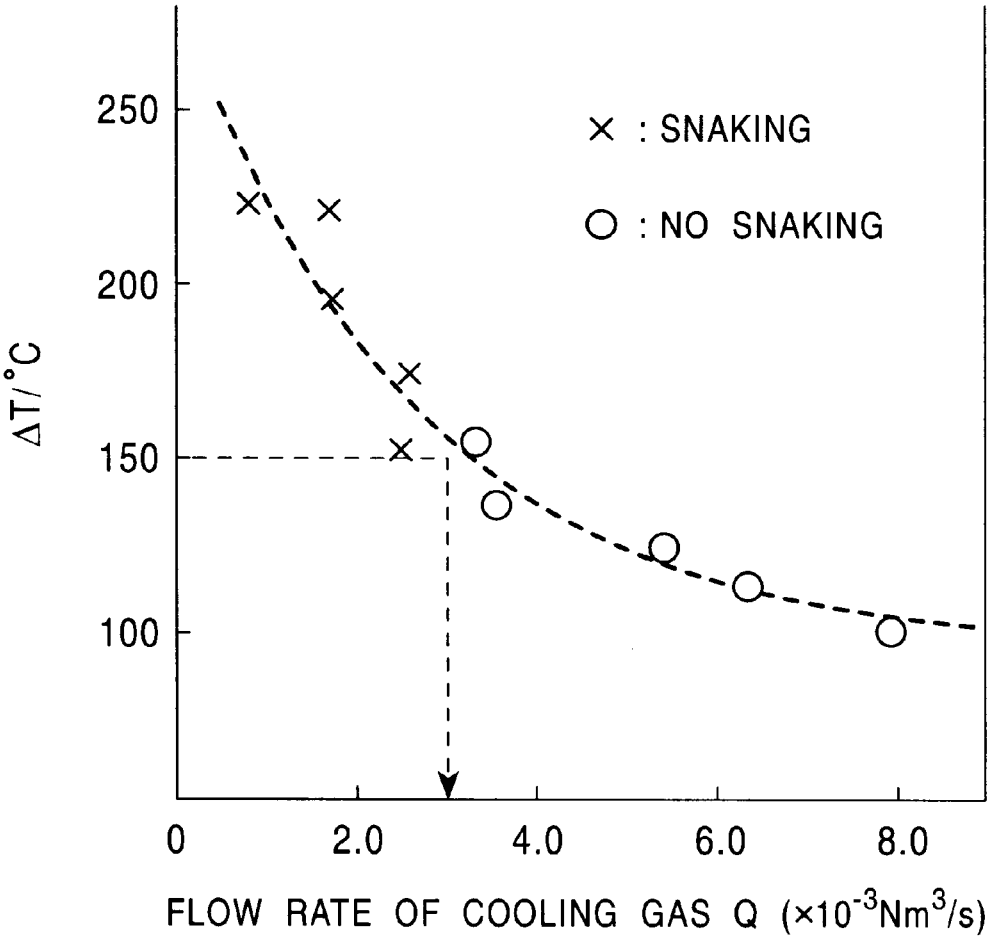
FIG. 4 is a graph showing the relationship among the flow rate of cooling gas, the temperature difference (ΔT) on a roll in the width direction of a strip, and the occurrence of snaking of the strip.

FIG. 4 is a graph showing the relationship between the flow rate of cooling gas (air) measured at the exhaust port of the outer tube of the double-walled tube according to this invention and a temperature difference ΔT developed on a temperature measuring roll in the width direction of a strip. The roll temperature measured had thermocouples embedded therein in the width direction of the roll and was positioned just above the radiant heat shielding apparatus which is almost paralell to the roll. Measurement conditions were set such that the length of a roll barrel was 2000 mm, the average width of steel strips passed through the furnace was 1260 mm, and the average furnace temperature was 900° C. Herein, the temperature difference ΔT was defined by ΔT=Te (roll surface temperature at a point spaced 100 mm from the roll edge)−Tc (roll surface temperature at the roll center). The graph of FIG. 4 shows that the minimum temperature difference ΔT, at which the roll crown is rendered concave and the steel strip undergoes snaking, is about 150° C. and that the flow rate of the cooling gas required for preventing snaking of the steel strip is not less than $3.0\times10^{-3}$ ($Nm^3/s$).

In the above-described first embodiment of this invention, the outside atmosphere suction port is described as being projected downward. However, the outside atmosphere suction port is not limited to such an arrangement. The outside atmosphere suction port may alternatively be projected at a different orientation, e.g., horizontally.

In the radiant heat shielding apparatus according to this invention, which comprises a double-walled tube having an outside atmosphere suction port projected horizontally or downward to be exposed to the outside atmosphere, and an exhaust port projected upward to be exposed to the outside atmosphere, the chimney effect developed on a flow in the double-walled tube from suction of the outside atmosphere to exhaust thereof is utilized to satisfy the above-mentioned required flow rate of the cooling gas.

From the law of conservation of mass for a fluid, the flow rate Q ($m^3/s$) of the cooling gas is given by the following equation:

$$Q=Vg\times\pi\times(D/2)^2 \tag{2}$$

where Vg is the flow speed (m/s) of the cooling gas at the exhaust port and D is the outer diameter (m) of the outer tube.

Also, from the law of conservation of energy for a fluid, the flow speed (m/s) of the cooling gas at the exhaust port is given by the following equation:

$$Vg=\sqrt{(2gH)} \tag{3}$$

where g is the acceleration of gravity (=9.8 $m/s^2$) and H is the level difference (m) between the outside atmosphere suction port and the exhaust port of the double-walled tube.

Combining formulae (2) and (3) results in the formula:

$$Q=\sqrt{(2gH)}\times\pi\times(D/2)^2 \tag{4}$$

According to formula (4), the flow rate Q of the cooling gas is proportional to the outer diameter D of the outer tube and is also proportional to the square root of the level difference H between the outside atmosphere suction port and the exhaust port of the double-walled tube.

Figure 5:
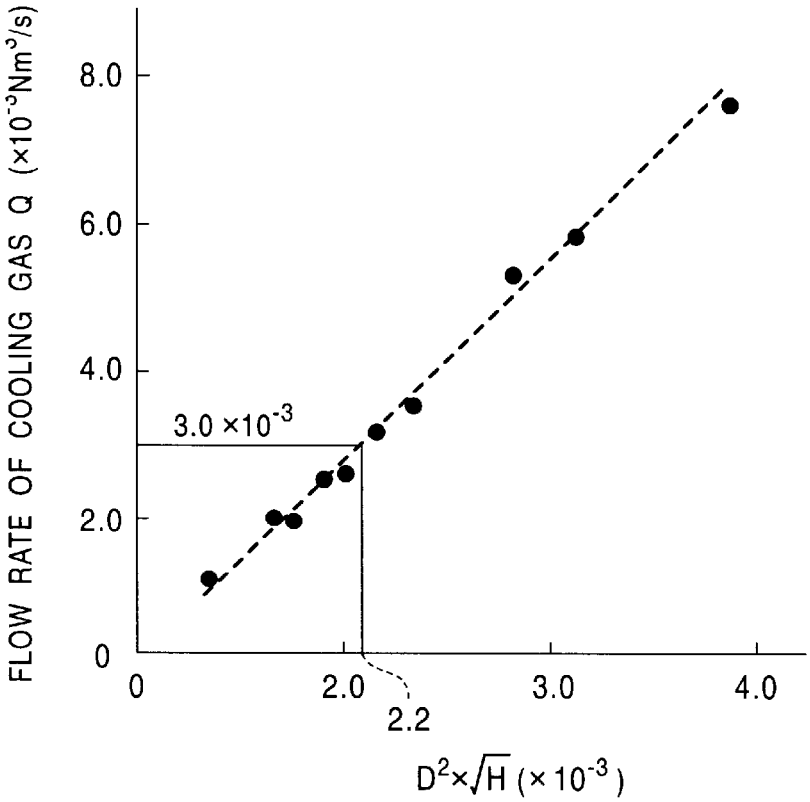
FIG. 5 is a graph showing the relationship between the flow rate of cooling gas and the product of the square of an outer diameter (D) of the outer tube and the square root of level difference (H)

FIG. 5 is a graph plotting actually measured data representing the relationship between the parameter $D^2\times\sqrt{(H)}$ indicated by the horizontal axis, and the flow rate Q ($Nm^3/s$) of the cooling gas, indicated by the vertical axis. The graph of FIG. 5 shows that $D^2\times\sqrt{(H)}\geqq2.2\times10^{-3}$ is needed to satisfy the required flow rate Q of the cooling gas that is not less than about $3.0\times10^{-3}$ ($Nm^3/s$). Stated otherwise, it is known that the furnace temperature ranges from about 500° C. to about 900° C. during actual operation, and when the furnace is within this temperature range, the flow rate of the cooling gas not less than the above-mentioned value is sufficient to achieve the desired cooling. Thus, if $D^2\times\sqrt{(H)}\geqq2.2\times10^{-3}$ is satisfied, a sufficient cooling effect can be provided during actual operation.

Figure 6:
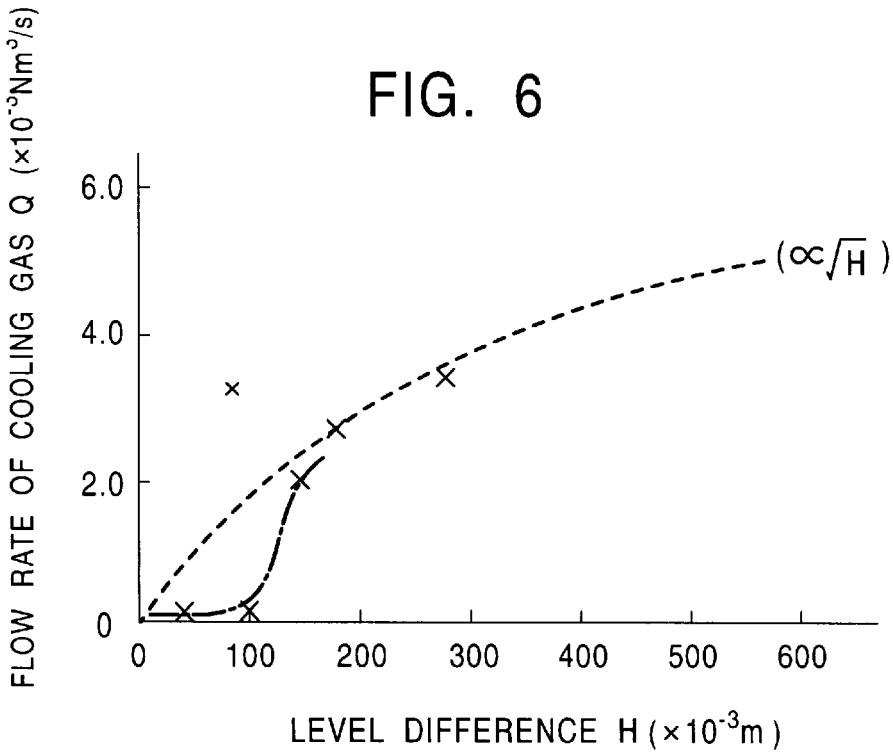
FIG. 6 is a graph showing the relationship between the flow rate of cooling gas (Q) and the level difference (H)

FIG. 6 is a graph showing the relationship between the flow rate Q ($Nm^3/s$) of the cooling gas and the level difference H (mm) between the outside atmosphere suction port and the exhaust port of the double-walled tube. The graph of FIG. 6 shows that if the level difference is less than about 150 mm, the cooling gas becomes difficult to flow because the level difference H is substantially at the same level as that corresponding to the diameter of the double-walled tube. Therefore, the level difference H between the outside atmosphere suction port and the exhaust port of the double-walled tube is preferably set to be not less than about 150 mm.

Also, if the outer diameter of the outer tube of the double-walled tube is small, the outer tube is more easily susceptible to creep due to the radiant heat. From the actual operation of the invention experienced so far, it has been confirmed that the outer diameter of the outer tube is preferably not less than about 60 mm.

Further, the outer diameter ratio between the outer tube and the inner tube of the double-walled tube is preferably in the range of from about 2.0 to about 4.0.

The outer tube is preferably made of stainless steel having a Cr content of not less than about 18 wt % and a Ni content of not less than about 8 wt %, which is represented by, for example, SUS304, SUS316 and SUS316L according to the JIS (Japanese Industrial Standards).

When installing the double-walled tube, the outside atmosphere suction port of the double-walled tube is preferably spaced about 100 mm or more from the furnace wall.

When the roll arranged in the furnace has a diameter several times as large as that of the double-walled tube of the radiant heat shielding apparatus, it is difficult to sufficiently intercept the heat radiated from the heating source toward the roll surface by using the radiant heat shielding apparatus that comprises one unit of double-walled tube. In such case, the radiant heat can be effectively intercepted by other embodiments of this invention shown in FIGS. 7 and 8. In the second embodiment of the invention shown in FIG. 7, a plurality of double-walled tubes 20 are arranged side-by-side horizontally just below the roll positioned in the upper portion of the furnace, and/or positioned just above the roll positioned in the lower portion of the furnace.

Figure 7:
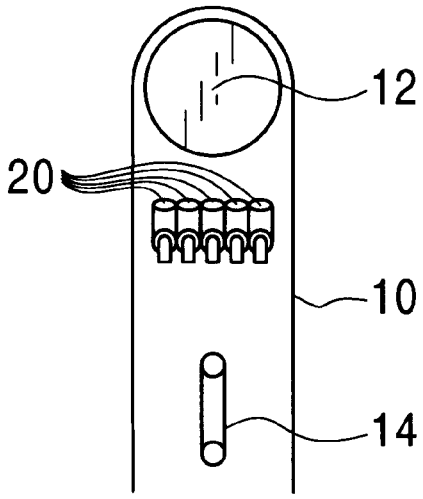
FIG. 7 is a side view showing the construction of a second embodiment of the radiant heat shielding apparatus according to this invention.
Figure 8:
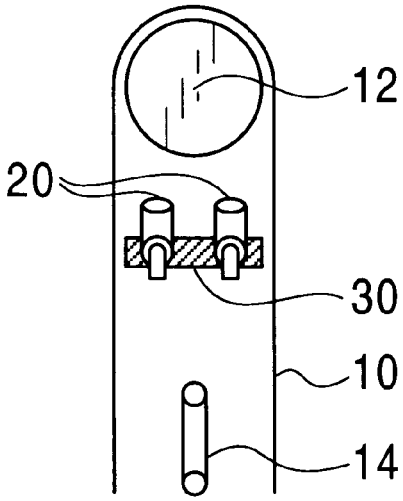
FIG. 8 is a side view showing the construction of a third embodiment of the radiant heat shielding apparatus according to this invention.

In the third embodiment of the invention shown in FIG. 8, one or more (two are shown) double-walled tubes 20 are used as support tubes and a shield plate 30 is attached to the support tubes as illustrated. FIGS. 7 and 8 also show the arrangement of rolls 12, heating sources 14 and strips 10.

EXAMPLE

Figure 13:
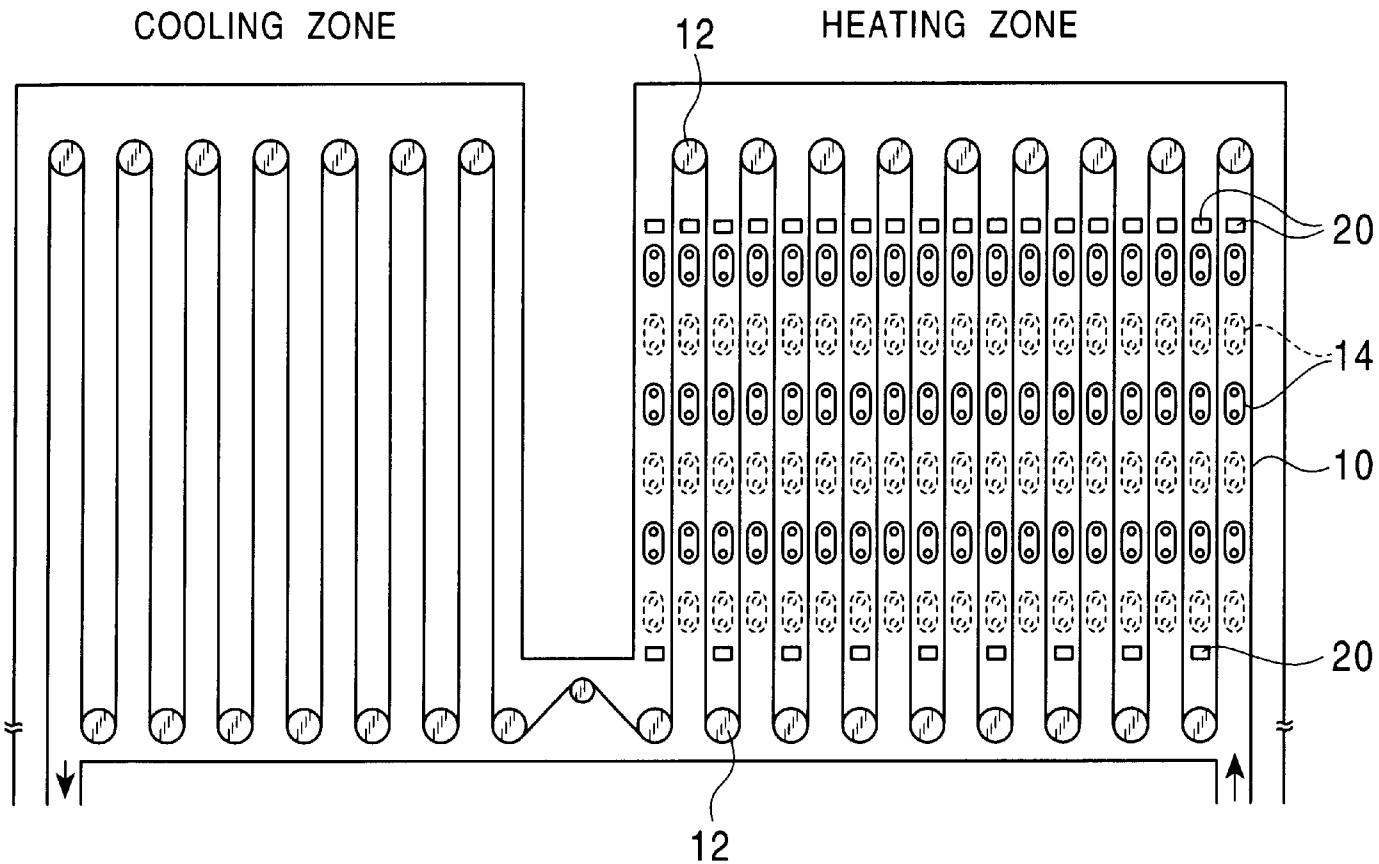
FIG. 13 is a schematic view of an annealing furnace including an embodiment of the radiant heat shielding apparatus of this invention.

Based on the above-described results obtained from the tests performed on actual apparatuses, the double-walled tube shown in FIG. 1 was fabricated using SUS316 stainless steel. The double-walled tube had an outer diameter D of the outer tube of 114.3 mm, an inner diameter of the outer tube of 97.1 mm, an outer diameter of the inner tube of 48.0 mm, and an inner diameter of the inner tube of 41.2 mm. The level difference H between the outside atmosphere suction port and the exhaust port of the double-walled tube was 200 mm. A plurality of radiant heat shielding apparatuses each comprising the double-walled tube thus fabricated were installed in upper and lower stages of a heating zone of a vertical continuous annealing furnace, as shown in FIG. 13. The radiant heat shielding apparatus was installed in the upper stage of the heating zone at a level spaced 400 mm from each roll just below it. Also, the radiant heat shielding apparatus was installed in the lower stage of the heating zone at a level spaced 400 mm from each roll just above it. The shielding effect of the actually installed radiant heat shielding apparatus was measured by operating the furnace for about two years under ordinary conditions.

Figure 9:
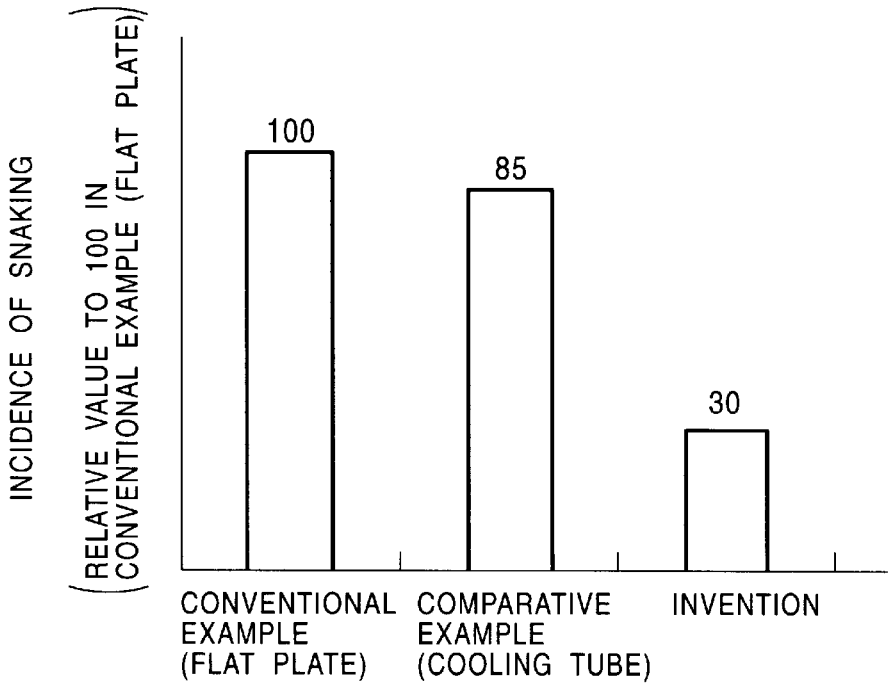
FIG. 9 is a graph showing, for comparison, the incidence of snaking in the conventional example using a flat plate, the comparative example using a simple cooling tube, and this invention.
Figure 10:
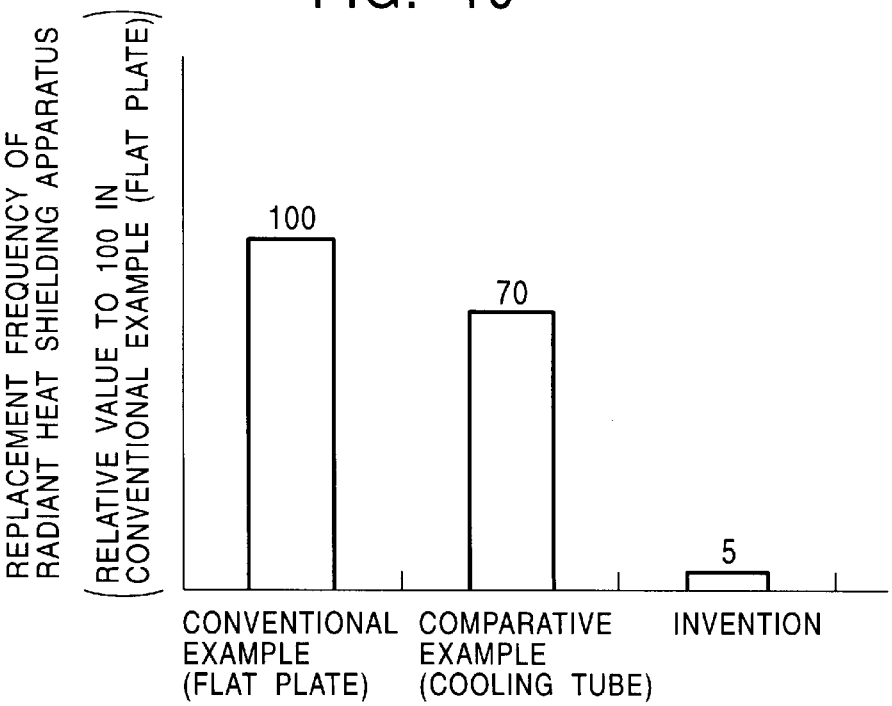
FIG. 10 is a graph showing, for comparison, the replacement frequency of the radiant heat shielding apparatus in the conventional example, the comparative example, and this invention.
Figure 11:
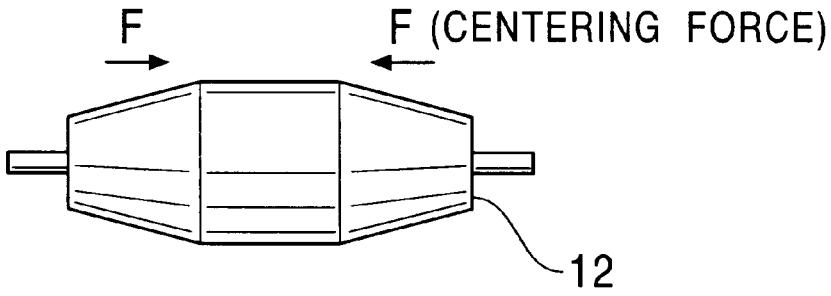
FIG. 11 is a front view showing a roll that is arranged in a furnace and has a convex roll crown.
Figure 12:
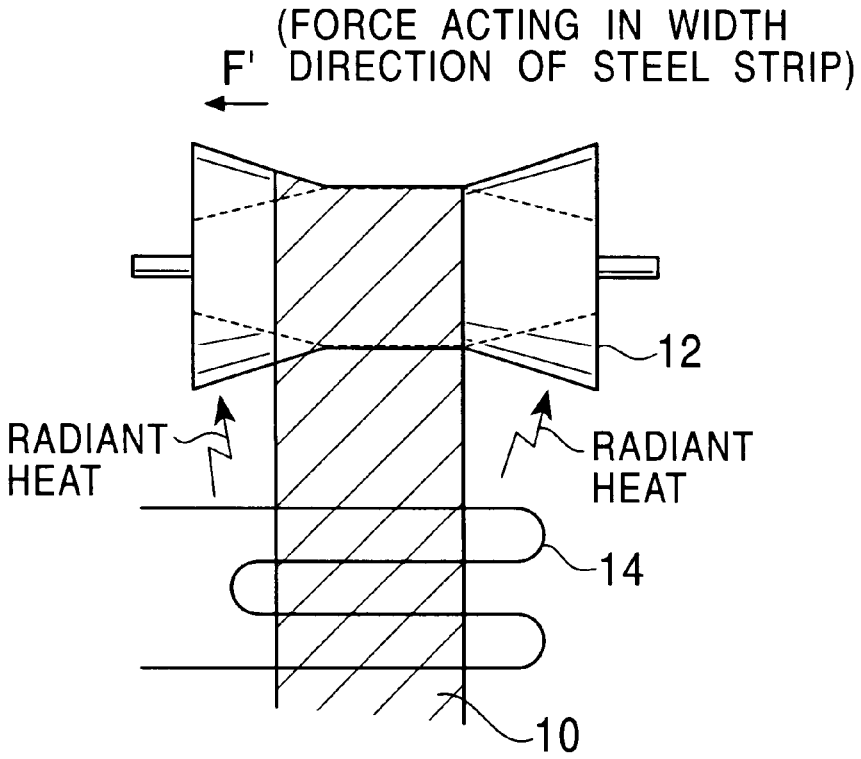
FIG. 12 is a front view showing a state where a strip is transported by a roll that is arranged in a furnace and has a concave crown due to a thermal crown imparted to the roll.

Results of the measurement are shown in FIG. 9 (incidence of snaking) and FIG. 10 (replacement frequency of the radiant heat shielding apparatus). In this invention, as shown in FIG. 9, the incidence of snaking is reduced down to about ⅓ as compared with both the conventional and comparative radiant heat shielding apparatuses using respectively a flat plate and a simple cooling tube. Also, as shown in FIG. 10, the useful life of the radiant heat shielding apparatus is greatly prolonged in this invention as compared with both the conventional and comparative apparatuses, because the cooling action is enhanced in this invention by effectively utilizing the chimney effect developed on a flow in the cooling tube from suction of the outside atmosphere to exhaust thereof.

Additionally, in the arrangement of FIG. 13, the radiant heat shielding apparatus of this invention including double-walled tubes 20 is disposed in the upper stage at a position between adjacent passes, i.e., at a position not just below each roll 12, as well. The shielding effect can be increased by so arranging the radiant heat shielding apparatus.

As described above, this invention can provide a radiant heat shielding apparatus, which is inexpensive, effective in preventing snaking of a strip, and has the prolonged useful life, because of effective utilization of the chimney effect that is developed for flow in a double-walled cooling tube from suction of an outside atmosphere to exhaust thereof.

What is claimed is:

1. A heat shielding apparatus for a vertical continuous annealing furnace including upper and lower portions and a plurality of rolls arranged in the upper and lower portions, heat treatment is performed on a metal strip continuously transported in the vertical direction by the rolls while changing a travel direction from upward to downward, or from downward to upward, as the metal strip turns around each of the rolls, the heat shielding apparatus is positionable just below a roll in the upper portion of the furnace and/or just above a roll in the lower portion of the furnace, the heat shielding apparatus comprising:

at least one double-walled tube, each double-walled tube including:

an outside atmosphere suction port projected horizontally or downward to be exposed to an outside atmosphere; and an exhaust port projected upward to be exposed to the outside atmosphere.

2. The heat shielding apparatus according to claim 1, wherein each double-walled tube comprises an inner tube including the outside atmosphere suction port projected horizontally or downward to be exposed to the outside atmosphere, and an outer tube having the exhaust port projected upward to be exposed to the outside atmosphere.

3. The heat shielding apparatus according to claim 2, wherein the outer tube of each double-walled tube has an outer diameter of not less than about 60 mm, a level difference H between the outside atmosphere suction port and the exhaust port of each double-walled tube of not less than about 150 mm, and the outer diameter D (unit: m) of the outer tube of each double-walled tube and the level difference H (unit: m) satisfy the relationship:

$$D^2 \times \sqrt{(H)} \geqq 2.2 \times 10^{-3}.$$

4. The heat shielding apparatus according to claim 1, wherein the apparatus comprises a plurality of double-walled tubes, the double-walled tubes being horizontally positionable just below the roll in the upper portion of the furnace and/or just above the roll in the lower portion of the furnace.

5. The heat shielding apparatus according to claim 2, wherein the apparatus comprises a plurality of double-walled tubes, the double-walled tubes being horizontally positionable just below the roll in the upper portion of the furnace and/or just above the roll in the lower portion of the furnace.

6. The heat shielding apparatus according to claim 3, wherein the apparatus comprises a plurality of double-walled tubes, the double-walled tubes being horizontally positionable just below the roll in the upper portion of the furnace and/or just above the roll in the lower portion of the furnace.

7. The heat shielding apparatus according to claim 1, wherein the apparatus comprises at least one double-walled tube, each double-walled tube is usable as a support tube and a shield plate is attached to each support tube.

8. The heat shielding apparatus according to claim 2, wherein the apparatus comprises at least one double-walled tube, each double-walled tube is usable as a support tube and a shield plate is attached to each support tube.

9. The heat shielding apparatus according to claim 3, wherein the apparatus comprises at least one double-walled tube, each double-walled tube is usable as a support tube and a shield plate is attached to each support tube.

10. A vertical continuous annealing furnace, comprising:

upper and lower portions;

a plurality of rolls arranged in the upper and lower portions;

wherein heat treatment is performed on a metal strip continuously transported in the vertical direction by the rolls while changing a travel direction from upward to downward, or from downward to upward, as the metal strip turns around each of the rolls;

a heat shielding apparatus disposed just below a roll positioned in the upper portion of the furnace and/or just above a roll positioned in the lower portion of the furnace, the heat shielding apparatus comprising:

at least one double-walled tube, each double-walled tube including:

an outside atmosphere suction port projected horizontally or downward so as to be exposed to an outside atmosphere; and an exhaust port projected upward so as to be exposed to the outside atmosphere.

11. The vertical continuous annealing furnace according to claim 10, wherein each double-walled tube comprises an inner tube including the outside atmosphere suction port projected horizontally or downward so as to be exposed to the outside atmosphere, and an outer tube having the exhaust port projected upward so as to be exposed to the outside atmosphere.

12. The vertical continuous annealing furnace according to claim 11, wherein the outer tube of each double-walled tube has an outer diameter D of not less than about 60 mm, a level difference H between the outside atmosphere suction port and the exhaust port of each double-walled tube of not less than about 150 mm, and the outer diameter D (unit: m) of the outer tube of each double-walled tube and the level difference H (unit: m) satisfy the relationship:

$$D^2 \times \sqrt{(H)} \geqq 2.2 \times 10^{-3}.$$

13. The vertical continuous annealing furnace according to claim 10, wherein the apparatus comprises a plurality of double-walled tubes, horizontally arranged just below the roll positioned in the upper portion of the furnace and/or just above the roll positioned in the lower portion of the furnace.

14. The vertical continuous annealing furnace according to claim 11, wherein the apparatus comprises a plurality of double-walled tubes, horizontally arranged just below the roll positioned in the upper portion of the furnace and/or just above the roll positioned in the lower portion of the furnace.

15. The vertical continuous annealing furnace according to claim 12, wherein the apparatus comprises a plurality of double-walled tubes, horizontally arranged just below the roll positioned in the upper portion of the furnace and/or just above the roll positioned in the lower portion of the furnace.

16. The vertical continuous annealing furnace according to claim 10, wherein the apparatus comprises at least one double-walled tube, and each double-walled tube is used as a support tube and a shield plate is attached to each support tube.

17. The vertical continuous annealing furnace according to claim 11, wherein the apparatus comprises at least one double-walled tube, and each double-walled tube is used as a support tube and a shield plate is attached to each support tube.

18. The vertical continuous annealing furnace according to claim 12, wherein the apparatus comprises at least one double-walled tube, and each double-walled tube is used as a support tube and a shield plate is attached to each support tube.

* * * * *